US005244376A

United States Patent [19]

Meyers

[11] Patent Number: 5,244,376

[45] Date of Patent: Sep. 14, 1993

[54] VARIABLE MOLD

[76] Inventor: Paul F. Meyers, 825 Perdew St., Ridgecrest, Calif. 93555

[21] Appl. No.: 886,494

[22] Filed: May 22, 1992

[51] Int. Cl.[5] ..... B28B 1/29; B28B 1/20

[52] U.S. Cl. ..... 425/425; 249/156; 425/459; 425/DIG. 119

[58] Field of Search ..... 425/263, 266, 267, 268, 425/459, 425, 426, 441, DIG. 37, DIG. 119; 249/113, 134, 114.1, 160, 115, 155, 156; 264/310, 311

[56] References Cited

U.S. PATENT DOCUMENTS

| | | | |
|---|---|---|---|
| 86,243 | 1/1869 | Newkumet | 425/263 |
| 337,632 | 3/1886 | Sheldon | 425/459 |
| 578,207 | 3/1897 | Burson | 425/263 |
| 1,377,785 | 5/1921 | Odelberg | 425/459 |
| 2,080,418 | 5/1937 | Gould | 425/263 |
| 2,503,678 | 4/1950 | Moore | 425/459 |
| 3,965,968 | 6/1976 | Alexandrov et al. | 425/425 |
| 3,980,419 | 9/1976 | Franz | 425/459 |
| 3,994,659 | 11/1976 | Takahashi | 425/425 |

FOREIGN PATENT DOCUMENTS

| | | | |
|---|---|---|---|
| 162388 | 9/1933 | Switzerland | 425/263 |

*Primary Examiner*—Khanh P. Nguyen
*Attorney, Agent, or Firm*—Roger A. Marrs

[57] ABSTRACT

A mold for use in the production of ceramic vessels is disclosed herein having a rotatable potters wheel head supporting a mold including a porous surface base disc releasably held in coaxial and concentric relationship with respect to the wheel head and which detachably carries a mold ring thereon about the periphery of the basic disc to define an inner cavity in which the shaping process is performed. A top rim is detachably carried on the mold ring and includes a porous surface for supporting ceramic material which downwardly depends into the mold cavity where pressure is applied to the unsupported portion of the material by finger tips to form a desired shape.

6 Claims, 1 Drawing Sheet

VARIABLE MOLD

BACKGROUND OF THE INVENTION

1. Field of the Invention

The present invention relates to the field of molds for producing ceramic vessels including the process involved and more particularly to a novel mold having a central ring defining cavity where unsupported portions of formable ceramic material may be manually manipulated into a variety of components so that a variety of ceramic vessels can be produced.

2. Brief Description of the Prior Art

In the past, a number of techniques have been employed for the production of ceramic vessels such as pots, vases or the like which either required a great deal of skill and a minimum of special equipment or which required extensive specialized equipment. One prior technique is referred to as "throwing on the potter's wheel" and this technique requires a maximum amount of training and skill on the part of the artisan. The possibilities for production are only limited by the skills and the imagination of the potter or artisan. Physically demanding, the output is limited by the strength and endurance of the potter. Another prior technique is known as "jiggering" and involves using a plaster mold centered on a special potter wheel. With the mold spinning, clay as a ceramic material is fully supported by the rigid mold and is roughly formed to the inside shape of the mold with the workman's fingers. The final shape and thickness is achieved by lowering a template on the end of a jigger arm into the spinning mold. The mold is removed with the shaped ceramic piece inside, set aside to dry and a new mold is placed on the potter's wheel for production of another piece. The advantage of this technique is that the resultant shape can be reproduced accurately. This stems largely from the fact that the walls of the mold are rigid and are configured to the desired shape so that the ceramic material can be pressed there against to assume the desired shape. Again, the ceramic material is completely supported during the performance of the technique which greatly limits the ability of the potter to vary the shape during the performance of the technique away from the shape of the rigid pre-shaped mold. Still another conventional process or technique is referred to as "ram pressing". This technique uses a hydraulic ram to form the material by employing pressure over a plaster mold. However, a separate mold must be made for any changes in the form or size of the object to be produced. The molds are difficult to construct and expensive to produce and represent a significant commitment to production on the part of a producer. Also, the hydraulic ram presses are extremely expensive and such presses offer very little versatility for making changes in design.

Therefore, a long standing need has existed to provide a novel ceramic vessel production technique and mold apparatus which employs a mold composed of several components which may be rapidly placed together in order to define a molding cavity in which unsupported portions of ceramic material can be worked on with the fingertips of an artisan. The walls of the material being worked on are unsupported so that a variety of shapes can be achieved by the user without changing molds or disrupting the molding process. Also, separate employment of component mold parts presents a variety of piece size, proportion and the overall general shape.

SUMMARY OF THE INVENTION

Accordingly, the above problems and difficulties are obviated by the present invention which provides a novel process and mold for shaping a ceramic material such as clay or the like wherein the mold includes basic disc having a porous surface that is rotatably carried on a potter's wheel head and wherein a molding or forming cavity is defined by the inner surface of a mold ring which is detachably carried on the peripheral edge of the base disc. Support means for the material mass is provided in the form of a top rim which is detachably connected to the mold ring and which has an opening in the center of the rim through which the ceramic material can downwardly depend into engagement with the porous surface of the base disc. The edge of the rim defining the central opening is in fixed spaced-apart relationship with respect to the porous surface of the base disc so that the downwardly depending ceramic material is unsupported.

The user's fingertips may be inserted through the rim opening and into contact with the unsupported ceramic material where manual pressure is applied for shaping and forming the material into shapes according to the plan and imagination of the user.

Therefore, it is among the primary objects of the present invention to provide a mold and molding process which required very little training or skill on the part of the user.

Another object of the present invention is to provide a novel mold and process for shaping a ceramic vessel utilizing the creative possibilities and imagination of the user so as to provide a variety of design variations.

Yet another object of the present invention is to provide a novel ceramic vessel mold and process wherein the mold is of lightweight construction, inexpensive to manufacture and which is durable and easily stored when not in use.

Still a further object of the present invention is to provide a novel mold and process wherein no special or expensive equipment such as ram presses or the like are required beyond the use of a standard potter's wheel.

Another object of the invention resides in using a mold and process wherein work is performed while the ceramic material or clay is unsupported in its plastic state so that no material is wasted and there is a minimum of reprocessing of materials.

Another object of the present invention resides in providing a novel mold system which incorporates a plurality of modular components which may be selectively combined so as to produce a wide variety of ceramic vessel shapes with a minimum number of modular components.

Yet another object resides in a novel mold apparatus having a defined mold cavity in which an unsupported portion of the material is manually manipulated by the user into selected imaginative shapes.

DESCRIPTION OF PREFERRED EMBODIMENT

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF PREFERRED EMBODIMENT

Figure 1:
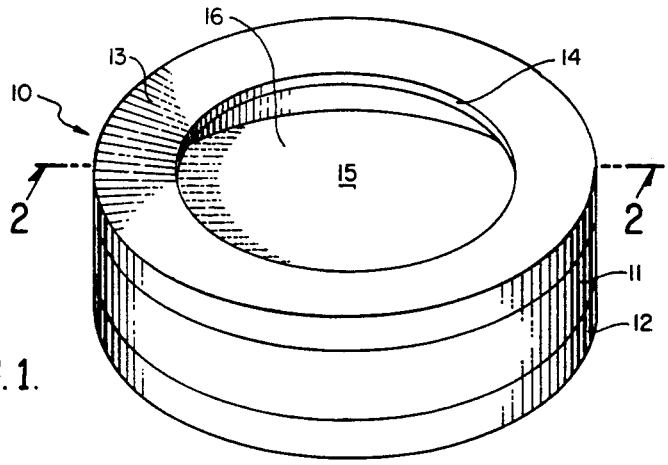
FIG. 1 is a front perspective view showing the novel mold used in the performance of the present invention.

Referring to FIG. 1, the novel mold apparatus of the present invention is indicated in the general direction of arrow 10 which includes a mold ring 11 supported on a conventional pottery wheel head 12. The mold ring supports a top rim 13 which includes a central opening 14 that defines an entrance leading into a forming cavity broadly identified by the numeral 15. The central opening also exposes the porous surface of a base disc 16 that rests directly on the wheel head 12. The forming cavity is defined by the opposing circular inner sidewall of the mold ring 11 and the porous surface of the base disc 16. The top rim 13 is employed for initially supporting a quantity of ceramic material such as clay and the exposed surface of the top rim is also porous so as to prevent sticking of the material thereto. Varying the diameter of the top rim opening 14 will allow variations in pottery design.

Figure 2:
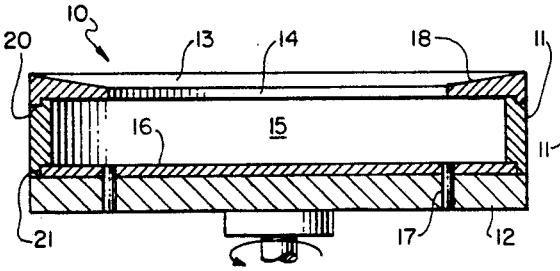
FIG. 2 is a transverse cross-sectional view of the mold shown in FIG. 1 as taken in the direction of arrows 2—2 thereof.

Referring now in detail to FIG. 2, it can be seen that the wheel head 12 includes a plurality of bat pins such as pin 17 which has a portion projecting through an opening in the base disc 16 so that detachable securement is made therewith. Such a securement aligns the mold 10 with the wheel head so that all mold parts are centered and moving concentrically when the wheel head is rotated. FIG. 2 also illustrates that the top rim 13 includes a downwardly sloping surface 18 extending from its outer perimeter to the opening 14. The top rim is detachably carried on the top of the mold ring by means of inter-engaging shoulders as represented by numeral 20. A similar type of shoulder engagement mounts the lower part of the rim 11 with the base disc 16 and such engagement is indicated by numeral 21.

Figure 3:
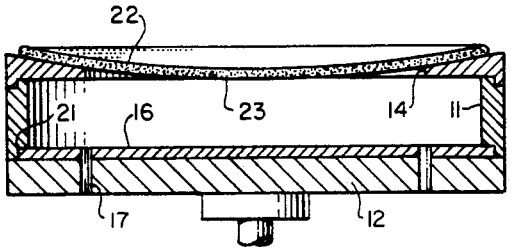
FIG. 3 illustrates the placement of a ceramic material on the mold preparatory for spinning and forming.

Referring now in detail to FIG. 3, ceramic material in the form of a sheet of clay 22 is placed over the central opening 14 and is supported in this position by frictional engagement of the underside of the edge marginal region of the clay with the porous surface of the top rim 13. As the wheel head 12 is rotated, the mold and the clay will spin and the central portion of the clay sheet as indicated by numeral 23 will progress by gravity into the direction of the base disc 16.

Figure 4:
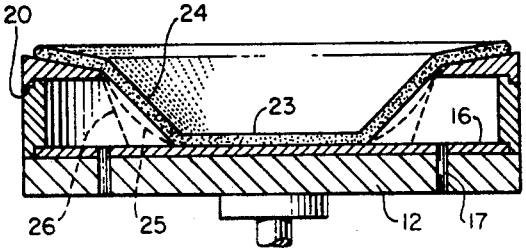
FIG. 4 is a view similar to the view of FIG. 3 illustrating the ceramic material being formed into selected shapes by applying pressure to the unsupported ceramic material.

Referring now in detail to FIG. 4, as the spinning continues, the central portion of the clay sheet as indicated by numeral 23 will come into contact with the base disc 16. Urging of the clay into contact may be achieved manually by using the fingertips of the mold user. Next, the user may direct his fingers to the sidewall portions of the clay sheet indicated by numeral 24 so that the unsupported portion of the sheet is positioned or deployed into any one of several shapes. For example, a curved shape is indicated by numeral 25 while a flat shape is indicated by numeral 26. These latter shapes are indicated in broken lines to show selection from the solid line position. The depth of the ceramic piece or clay is determined by the height of the mold ring and the number of mold rings used.

Figure 5:
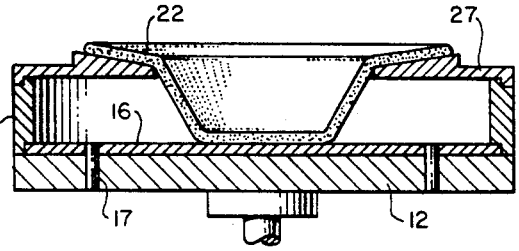
FIGS. 5, 6 and 7 illustrate the novel mold comprising a variety of different components in order to produce a ceramic vessel of different diameters, height and sizes.
Figure 6:
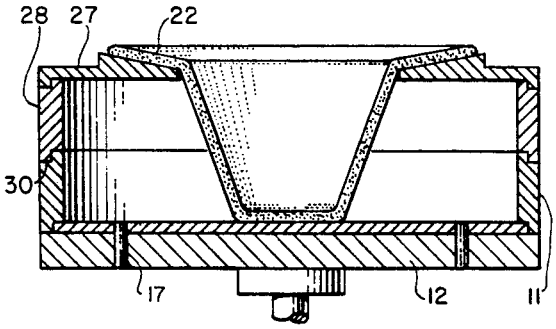
Figure 7:
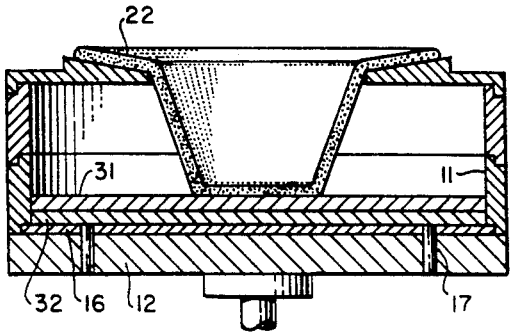

In FIGS. 5, 6 and 7 multiple mold parts or components are illustrated so that a variety of end-product ceramic vessels or pieces can be developed. In FIG. 5, the diameter of the resultant piece can be changed by employing a top rim of lesser diameter in the opening 14 than that shown in FIG. 2. Also, the angle of depression for the upper lip of the ceramic piece can be changed by varying the degrees of slope and such a variation in top member is indicated by numeral 27. In FIG. 6, multiple mold rings are added so as to vary the height of the resultant ceramic vessel and the additional multiple mold ring is indicated by numeral 28. This ring is supported by a shoulder engagement 30 as previously described directly onto the top of the mold ring 11. In FIG. 7, another variation including component parts as illustrated by including several additional discs to the base disc 16 and such additions are indicated by numerals 31 and 32 respectively.

Thus, it can be seen that a ceramic vessel may be formed by use of the present mold apparatus into a variety of configurations and shapes. The desired mold parts are snapped together and attached to the wheel head on the bat pins. These pins automatically center the entire mold and insure concentricity. A slab of clay approximately ⅜ of an inch thick is placed over the mold rim 13 so as to cover the opening 14. Next, with the wheel turning at a moderate speed, finger pressure is applied to flatten the rim with the fingertips. Pressure is applied to the unsupported clay to form a concave shape. The bottom of the ceramic vessel is created by gently pressing the clay against the base disc. The finished piece can be readily removed immediately by lifting the mold top rim from the mold ring. A new top rim is placed on the mold and the process is repeated.

Once removed, the top rim including the formed ceramic piece is placed to dry until it can be inverted from the top rim making contact with the clay be composed of a porous material to prevent the clay from sticking. This is also true of the ceramic material engaging surface of the bottom disc.

The shape of the mold does not dictate the shape of the finished product since many shapes can be designed and made within a single mold. This stems largely from the fact that the side portions of the ceramic vessel are unsupported during the forming procedure. Since the mold is not specific to one shape, the mold can easily be made deeper, or the diameter of the mold rim easily changed so as to result in even more possibilities for variations in form.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A mold comprising:

a ceramic material;

a base disc;

at least one mold ring detachably carried on said base disc;

a top rim detachably carried on said mold ring supporting said ceramic material and said top rim having a central opening leading into a forming cavity;

said forming cavity defined by opposing surfaces of said top rim and said base disc;

said top rim and said base disc in fixed spaced-apart relationship wherein said space constitutes an unsupported area in said forming cavity by said ceramic material intended to be manually shaped;

a rotatable wheel head supporting said base disc in coaxial relationship therewith whereby said top rim and mold ring are concentric and centered with respect to said wheel base; and said top rim includes a downwardly sloping surface terminating at said central opening;

said base disc and said top rim surface having a porous surface effective to part with said ceramic material.

2. The invention as defined in claim 1 wherein:

said mold ring includes a plurality of rings coaxially disposed on top of each other to provide a mold cylinder.

3. The invention as defined in claim 1 including:

a plurality separate discs supported on said base disc reducing the depth of said forming cavity.

4. The invention as defined in claim 1 wherein:

said top rim sloping surface and a surface of said base disc defining said forming cavity are porous so as to effect release of said ceramic material at the completion of the forming procedure.

5. The invention as defined in claim 4 wherein:

said top rim having a peripheral protrusion and said mold ring having a peripheral relieved portion wherein said protrusion and said relieved portion provide a detachable engagement therebetween.

6. The invention as defined in claim 5 wherein:

said central opening includes a circular edge in spaced apart and fixed relationship with respect to said base disc and said ceramic material drapes downwardly from said edge to rest on said base disc that sidewall portions of said ceramic material are unsupported within said forming cavity.

* * * * *